US006767444B1

(12) United States Patent
Miller et al.

(10) Patent No.: US 6,767,444 B1
(45) Date of Patent: Jul. 27, 2004

(54) METHOD FOR PROCESSING SPENT (TRU, ZR)N FUEL

(75) Inventors: William E. Miller, Naperville, IL (US); Michael K. Richmann, Woodridge, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 10/227,401

(22) Filed: Aug. 26, 2002

(51) Int. Cl.[7] ..... C25B 1/00; C25C 1/22; C25C 3/34

(52) U.S. Cl. ..... 205/43; 205/46; 205/47; 205/49; 205/44; 205/615

(58) Field of Search ..... 205/43, 46, 47, 205/49, 44, 615

(56) References Cited

U.S. PATENT DOCUMENTS 4,880,506 A * 11/1989 Ackerman et al. ..... 205/44

* cited by examiner

*Primary Examiner*—Wesley A. Nicolas
(74) *Attorney, Agent, or Firm*—Bradley W. Smith; Mark P. Dvorscak; Paul A. Gottlieb

(57) ABSTRACT

A new process for recycling spent nuclear fuels, in particular, mixed nitrides of transuranic elements and zirconium. The process consists of two electrorefiner cells in series configuration. A transuranic element such as plutonium is reduced at the cathode in the first cell, zirconium at the cathode in the second cell, and nitrogen-15 is released and captured for reuse to make transuranic and zirconium nitrides.

13 Claims, 2 Drawing Sheets

METHOD FOR PROCESSING SPENT (TRU, ZR)N FUEL

CONTRACTUAL ORIGIN OF INVENTION

The United States Government has rights in this invention pursuant to Contract No. W-31-109-ENG-38 between the U.S. Department of Energy and the University of Chicago, representing Argonne National Laboratory.

BACKGROUND OF THE INVENTION

1. Field of the Invention

This invention relates to an improved method for the processing of spent nuclear fuel, and, more specifically, this invention relates to an improved process for recycling spent nuclear fuel containing transuranic and zirconium nitrides [(TRU, Zr)N] and recovering metal values and nitrogen-15.

2. Background of the Invention

A mixture of plutonium and zirconium nitrides is being considered as a prospective fuel for Plutonium Burner reactors, and for accelerator driven reactors such as those for Accelerator-driven Transmutation of Waste (ATW). The purpose of using said fuel is to consume or transmute plutonium into less hazardous elements. The fuel is comprised of about 75% zirconium nitride and 25% plutonium nitride. The nitride is from nitrogen-15 ($^{15}N$), which has only a 0.366% natural abundance, compared to its more abundant isotope, $^{14}N$.

Current United States policy is to store unprocessed spent reactor fuel in a geologic repository. Long-term uncertainties are hampering the acceptability and eventual licensing of a geologic repository for nuclear spent fuel in the U.S., and driving up its cost. The resistance among Yucca Mountain Range residents and others regarding the government's plans to deposit radioactive material in the Yucca Mountain Repository is a case in point.

Instead of long term storage of untreated radioactive materials, preliminary treatment of spent nuclear fuel is being explored, including partial utilization of the fissile material contained in the spent fuel. Accordingly, there is an emphasis upon developing new technologies for reprocessing and reutilizing spent nuclear fuels.

A number of processes exist for the processing and recycling of nuclear fuels. These processes often involve aqueous solutions. Due to the presence of water, aqueous solutions are neutron moderators. In thermal reactors, the neutrons that cause fission are at a much lower energy than the energy level at which the same neutrons were born from fission. Through collisions between water nuclei and neutrons created by the spontaneous fission of plutonium, water in the aqueous solutions lowers the neutrons' kinetic energies and readies these neutrons to cause fission. Accordingly, neutron moderation makes the critical mass of plutonium low for aqueous solutions. The low critical mass necessitates the use of very low plutonium concentrations and redundant safeguards to assure fission control. This results in low plutonium throughputs. Thus, aqueous solution processing and recycling of nuclear fuels is inefficient and not cost-effective.

At present, no complete process exists for the processing and treatment of nitride-based nuclear fuels.

The recovery of $^{15}N$ from spent nuclear fuels is also very important. Nitrogen, as nitride, is a large fraction of many nuclear fuels. The driving force of a nuclear reactor using nitride fuels is the thermal neutron flux. Reactor core designs require that the fissionable material capture a large fraction of the neutrons. However, if neutrons are intercepted prior to their capture by fissionable material, such as by such as structural materials, fuel matrix, fuel cladding, and coolant, the neutrons are lost, and the reactor design is less efficient. Atmospheric nitrogen is made up of two isotopes, $^{14}N$, and $^{15}N$ with respective abundances of 99.634% and 0.366%. Of the two isotopes, $^{14}N$ is more likely to be intercepted by non-fissionable material than $^{15}N$ because the neutron cross-section of $^{14}N$ is 91,500 times greater than the neutron cross-section of $^{15}N$. Thus, $^{15}N$ is required for nitride fuels to make a reactor's design reasonably neutron-efficient. Currently, costly isotope separation process is employed to capture $^{15}N$ from the atmosphere for fuel manufacture. However, since $^{15}N$ is so expensive, efforts have been made to also recapture $^{15}N$ from spent fuel.

A method has been developed for the recovery of transuranic metals from nitrides by electrolysis in LiCl-KCl melts. Osamu Shirai, Masatoshi Iizuka, Takashi Iwai, Yasufumi Suzuki, and Yasuo Arai, "Recovery of Neptunium by Electrolysis of NpN in LiCl-KCl Eutectic Melts," Journal of Nuclear Science and Technology, Vol. 37, No. 8, pp. 676–681 (August 2000).

U.S. Pat. No. 5,372,794 awarded to LeMaire, et al. on Dec. 13, 1994 discloses a process for separation of actinides from aqueous solutions.

U.S. Pat. No. 5,132,092 awarded to Musikas on Jul. 21, 1992 discloses an aqueous process for the extraction of uranium (VI) and plutonium (IV).

U.S. Pat. No. 5,085,834 awarded to LeMaire, et al. on Feb. 4, 1992 discloses an aqueous method for separating plutonium from uranium and from fission products.

U.S. Pat. No. 4,740,359 awarded to Hadi Ali, et al. on Apr. 26, 1988 discloses an organic-aqueous process for recovering uranium values.

U.S. Pat. No. 4,399,108 awarded to Krikorian et al. on Aug. 16, 1983 discloses a carbothermic reduction method for the recovery of actinides.

U.S. Pat. No. 4,297,174 awarded to Brambilla on Oct. 27, 1981 discloses a pyroelectrochemical process for reprocessing irradiated nuclear fuels. The process involves dissolving fuel to be reprocessed in a fused-salt bath.

U.S. Pat. No. 4,092,397 awarded to Brambilla, et al. on May 30, 1978 discloses a method for the pyrochemical separation of plutonium from irradiated nuclear fuels, by thermal decomposition in molten nitrates.

U.S. Pat. No. 3,981,960 awarded to Brambilla, et al. on Sep. 21, 1976 discloses a reprocessing method of ceramic nuclear fuel in low-melting nitrate molten salts.

Several of these patents teach less efficient aqueous separation processes. Also, none of the aforementioned patents or publications disclose a method for capture and recycling of $^{15}N$. Further, none of the aforementioned patents or publications anticipate or suggest direct electrochemical reduction of transuranic nitrides and zirconium nitride in melts of the respective transuranic and zirconium metal chlorides.

A need exists in the art for a method and device for isolating elements of nitride-containing nuclear fuel. The method should not require aqueous or nonaqueous separation techniques. The method and device should separate the nitrides of transuranics and zirconium. Also, the method and device should allow for the different reduction potentials of transuranic metal ions and zirconium ion, and for the capture of $^{15}N$.

SUMMARY OF INVENTION

An object of the present invention is to provide a process of efficiently processing and recycling spent nitridebased nuclear fuels that overcomes many of the disadvantages of the prior art.

Another object of the present invention is to provide a nonaqueous system for the recovery of metal values from spent nuclear fuel rods. A feature of the invention is that the spent fuel rods are placed in a metal anode basket and transuranic metals and/or zirconium metal are isolated from, but recovered simultaneously with, $^{15}N$ by direct electrochemical reduction. An advantage is that costs are lowered due both to fewer steps in the recovery of the metal and nitrogen, and to higher throughputs of transuranic metals.

Still another object of the present invention is to provide a method for the recovery of transuranic metals and zirconium metal by electrolysis in a bath of chlorides of the same metals. A feature of the invention is that transuranic metal ions and zirconium ions emanating from the anode replace the ions in the melt which in turn discharge at the cathode, forming the metal. An advantage of the invention is that the reduced metal is collected directly from the cathode in concentrated form.

It is another object of the present invention to provide a method for recovery of $^{15}N$, bound as nitride ion in fuel rods. A feature of the invention is that $^{15}N$ is carried by an inert carrier gas over liquid nitrogen traps. An advantage of the device is that a considerable savings in costs occurs due to the capture and recycling of the $^{15}N$.

Yet another object of the present invention is to provide a device and method for separating transuranic metals and zirconium metal from alkali, alkaline earth, rare earth, and noble metal fission products and from each other. A feature of the invention is that residual fission product metals present in the spent fuel rods accumulate in both the metal anode basket and the chloride bath as oxidized metal. An advantage of the invention is that transuranic metals and zirconium metal of high purity are produced, separately in a serial procedure at a corresponding cathode in electrical communication with the anode. That is, separation and collection of one metal occurs prior to the separation and collection of another metal, even though both metals are contained in the same starting material matrix and the entire matrix is processed at the beginning of the isolation/purification procedure.

Briefly, the invention provides a process for separating the constituents of spent nuclear fuel comprising a first nitride compound and a second nitride compound, the process comprising loading spent fuel in an anode basket; suspending the basket in a first molten electrolyte; placing a first cathode in the first molten electrolyte; applying a first voltage between the anode basket and the first cathode so as to oxidize the metal contained in the first nitride compound and electrolyte and allow the oxidized metal to transform to elemental metal at the cathode; removing the anode basket; placing the anode basket in a second molten electrolyte; placing a second cathode in the second molten electrolyte; and applying a second voltage between the anode basket and the second cathode so as to oxidize metal contained in the second nitride compound and second electrolyte and allow the oxidized metal to transform to elemental metal at the second cathode.

The invention also provides a device for recovering transuranic metal, zirconium metal, and nitrogen-15 ($^{15}N_2$) from a mixture of nitrides, the device comprising a means for placing transuranic and zirconium nitrides in an electrolyte; a means for reducing transuranic metal ions; a means for reducing zirconium metal ions; a means for oxidizing nitride ions: a means for collecting the nitrogen gas; and a means for collecting the transuranic and zirconium metal.

BRIEF DESCRIPTION OF DRAWING

The invention together with the above and other objects and advantages will be best understood from the following detailed description of the preferred embodiment of the invention shown in the accompanying drawing, wherein.

DETAILED DESCRIPTION OF THE INVENTION

This invention provides a device and a process for processing spent nuclear fuel. Generally, the protocol combines electrochemical processes with ceramic and metallurgical processes. In particular, the instant invention provides a device and process for the recovery of materials residing together in a substrate. The invention isolates the metals from each other, isolates nonmetal moieties from the metals, and simultaneously purifies the desired fractions. Exemplary materials targeted for isolation and purification include zirconium, uranium, plutonium, and elements contained in the actinide- and transactinide-series.

The invention is suitable for extracting and isolating metals found in spent nuclear fuel, both from each other, and simultaneously from nitrogen-15, the last of which is also contained in spent fuel.

Figure 1:
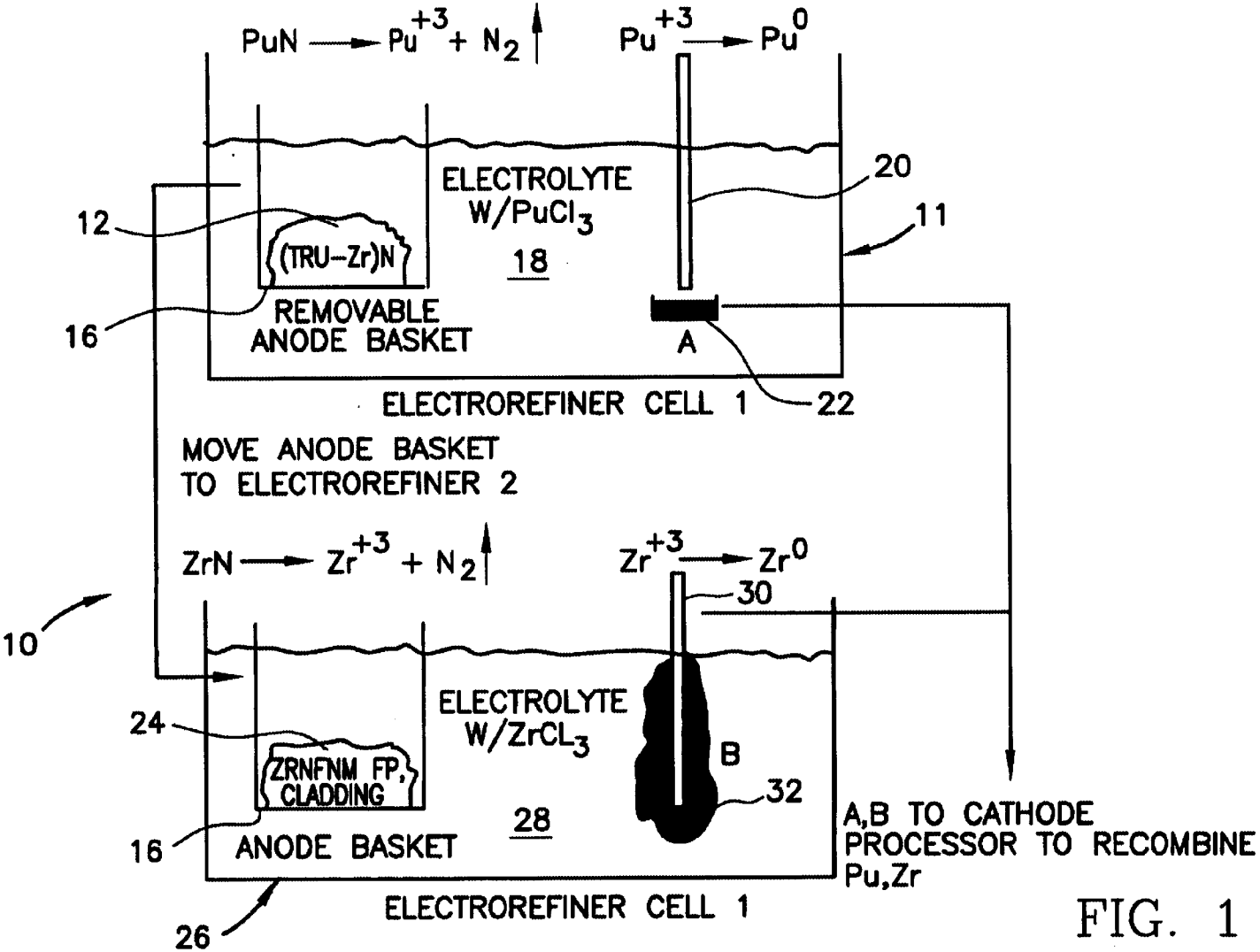
FIG. 1 is the schematic diagram of a flow chart which outlines the key steps of reprocessing of nitride fuel, in accordance with features of the present invention.

The device primarily consists of two electrorefiner cells in a series configuration. A schematic diagram of the device and process is depicted in FIG. 1 as numeral 10. This process can be located in situ or off-site from the point where fissionable material is utilized. An obvious practical application of the invention is the reprocessing of nuclear fuel. In this scenario, a supply of spent nuclear fuel serves as the reactive substrate. The spent fuel 12 is subjected to an electrolytic process in a first cell 11. The process reduces transuranic ions such as plutonium ($^{239}Pu^{3+}$) and simultaneously oxidizes nitrogen-15 nitride ion ($^{15}N^{3-}$).

In the first cell 11, the spent fuel containing a plurality of metal nitrides is placed in a removable anode basket 16 suspended in, or otherwise contacting a first molten electrolyte 18. The electrolyte 18 contains the transuranic chloride of the same transuranic element present in the spent fuel. An exemplary form of the spent fuel is spent fuel rods.

A first cathode 20 is partially immersed in the first molten electrolyte 18. A first voltage is applied between the anode basket 16 and the first cathode 20. The first cell 11 decomposes plutonium nitride, PuN, for example, to liquid Pu 22 according to the following equations:

$$PuN(I) \rightarrow Pu^{3+}(I) + \tfrac{1}{2}N_2(g)\uparrow + 3e^- \qquad \text{Anode Equation 1:}$$

$$Pu^{3+}(I) + 3e^- \rightarrow Pu^0(I) \qquad \text{Cathode Equation 1:}$$

The $Pu^{3+}$ released by oxidation of the $N^{3-}$ ion at the anode replaces a $Pu^{3+}$ ion simultaneously reduced at the cathode. The same occurs for other transuranic elements so processed. Essentially, the ionized metal is in electrical communication with the cathode, thereby leading to its reduction to elemental metal upon contact with the cathode.

The first voltage present in the first electrorefiner cell is selected and maintained at a level sufficiently below that necessary for the reduction of any other metal present in the spent fuel. This allows for reduction of the first metal ion moiety while the other metal ion moiety remains combined with nitride for eventual transport to another electrorefiner cell 26. A reasonable level of purity is thus attained in the electro-refinement of both metals.

Subsequent to processing of the spent fuel in the first cell 11, the anode basket 16 containing ZrN and noble metals 24 is removed and placed in an electrorefiner cell 26, which contains a second molten electrolyte 28. The second molten electrolyte is comprised of a salt selected from the group consisting of lithium salt and a zirconium salt. Suitable lithium salt include those salts selected from the group consisting of lithium chloride (LiCl) and lithium fluoride (LiF). Suitable zirconium salts include those salts selected from the group consisting of zirconium chloride ($ZrCl_3$) and zirconium fluoride ($ZrF_3$).

A second cathode 30 is suspended and partially immersed in the second molten electrolyte 28. A second voltage is subsequently applied between the anode basket 16 and the second cathode 30. In a manner analogous to that of the first cell 11, the second cell 26, decomposes zirconium nitride, ZrN, to crystalline zirconium 32 according to the following equations.

$$ZrN(s) \rightarrow Zr^{3+}(I) + \tfrac{1}{2}N_2(g)\uparrow + 3e^- \qquad \text{Anode Equation 2:}$$

$$Zr^{3+}(I) + 3e^- \rightarrow Zr^0(s) \qquad \text{Cathode Equation 2:}$$

In the first cell 11, the spent fuel 12 is maintained at a temperature higher than the melting temperature of plutonium (641° C.). This allows the liquid plutonium 22 to be readily collected for cathode processing at the first cathode 20 of the first cell 11. $Pu^{3+}$, now in electrical communication with the cathode, migrates through the melt continually displacing or pushing forward (toward the cathode) the $Pu^{3+}$ already in the melt and associated with chloride or fluoride ion. The displaced $Pu^{3+}$ makes electrical contact with the cathode and is reduced to liquid plutonium metal. The process is the same for other transuranic nitrides and their cations associated with chloride in the melt.

In a manner analogous to that of the $Pu^{3+}$ in the first cell 11, $Zr^{3+}$ in the second cell 26 migrates through the second molten electrolyte 28 continually displacing or pushing forward toward the cathode the $Zr^{3+}$ already in the melt and associated with chloride ion. The $Zr^{3+}$ pushed forward makes electrical contact with the second cathode 30 and is reduced to crystalline zirconium metal 32.

The anode basket 16 in the first cell 11 acts as the point of electrical contact for fuels that are metallically clad. A ferrous metal contact such as a metal sponge is used in the anode basket for fuels that are not metallically clad.

The applied voltage needed to electrolytically decompose ZrN is 200 milli-Volts (mV) more negative than that needed to decompose PuN. The least negative applied voltage that gives a steady current, (e.g., the decomposition of PuN) is experimentally determined. To electrolytically decompose ZrN, the applied voltage must be increased to the reduction potential of $Zn^{3+}$, by 200 mV (i.e., 200 mV more negative) if the transuranic metal ion reduced was $Pu^{3+}$ in the first electrorefiner. This does not happen because the cycler or controller is set at a significantly lower voltage cutoff limit. Further, ZrN does not react chemically with components in the first cell electrolyte, so that $ZrCl_3$ cannot enter the electrolyte. These two principles cause selective decomposition of PuN in the first electrorefiner 11, for example, while the ZrN 24 remains in the anode basket.

A feature of the invention is that elemental metals are extracted from spent nuclear fuel substrate in a phase different than that of nitrogen-15. For example, as elemental metals are generated in either the liquid (Pu) in the first cell 11 or solid (Zr) phase in the second cell 26, and the nitrogen-15 in the gaseous phase, production and isolation of these three elements is facilitated. Simultaneous with the decomposition of the metal nitride to elemental metal, gaseous $^{15}N_2$ is generated. The gaseous phase collects in the off-gas in the head space volume above the electrorefiner. The volume above the device is swept by an inert carrier gas such as helium. The resultant gaseous mixture is then contacted with a nitrogen gas condensation means, such as liquid nitrogen, [$N_2$(I)], traps, This condensation step liquefies the nitrogen-15 so as to facilitate its separation from remaining moieties still entrained in the off gas. The separated $^{15}N_2$ is collected for eventual reincorporation into metal nitride fuel.

The first cell's electrolyte accumulates as chlorides, alkali metals, alkaline earth metals, and rare earth metal fission products. When the first cell's electrolyte reaches a maximum concentration of these chlorides, the plutonium chloride concentration is at, or will be reduced to, a minimum. The resultant salt, containing only a small amount of plutonium, in the range of 10 to 100 parts per million (ppm), is then processed into a glass-sodalite ceramic waste form.

In the second cell 26, the spent fuel is maintained at the nominal operating temperature of 700° C., well below zirconium's melting point temperature of 1852° C. The zirconium from the spent fuel becomes $ZrCl_3$ while other $ZrCl_3$ migrates through the electrolyte to the cathode where the $ZrCl_3$ is reduced to Zr metal crystals 32. In a fashion identical to that for the first cell 11 supra, gaseous $^{15}N_2$ is mixed with a flowing, relatively inert carrier gas and collected. The carrier gas can be any relatively inert gas or any vapor-phase fluid which does not react with the nitrogen at the temperature and/or pressure present.

Figure 2:
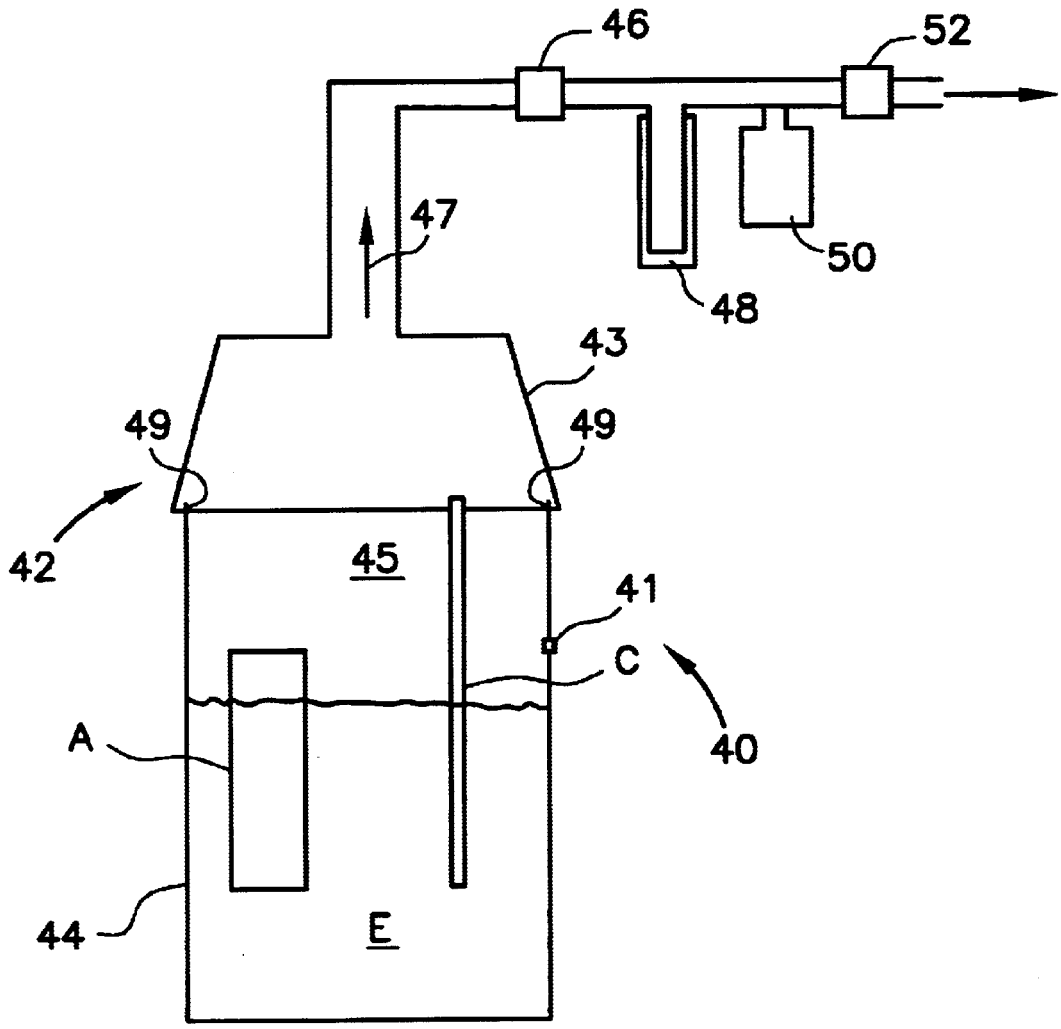
FIG. 2 is the schematic diagram of a nitrogen-15 collection system, in accordance with features of the present invention.

FIG. 2 is a schematic diagram of an exemplary collection system for gaseous nitrogen-15 ($^{15}N_2$). The system 40 comprises a sealed gas collection device 42 which is adapted to contact an electrorefiner 44 via a shroud 43 adapted to capture vapor products emanating from the electrorefiner 44. It should be noted that the electrorefiner 44 is a generic paradigm of the two electrorefiners 11, 26 discussed supra. As such, the electrorefiner 44 contains an electrolyte E and an anode A and cathode E immersed therein.

Once in place, the shroud 43 defines a reaction atmosphere 45. The shroud is constructed so as to make a reversible hermetic seal with the electrorefiner 44, in that the shroud is removably attachable to a peripheral, upwardly extending lip 49 of the electrorefiner, the lip defining an opening into the refiner.

The atmosphere 45 is swept with inert gas, such as helium, He, to produce a stream 47. The inert gas gains access to the atmosphere via any standard, self sealing fluid passageway 41 formed in a wall of the container defining the sides of the electrorefiner. The passageway 41, be it configured to accommodate an elastomeric septum insert, a snap-on configuration, or some other standard aperture sealing paradigm, is adapted to receive an inert gas supply line. Alternatively, the passageway 41 can be threaded so as to receive a nipple and/or a gate valve so as to provide a valved closing means at the passageway.

Ultimately, $^{15}N_2$-laden product stream 47 passes through a gate valve 46, then over a liquid nitrogen trap 48 to liquify the vaporized $^{15}N_2$. The liquid nitrogen is collected at a nitrogen reservoir 50 while another gate valve 52 downstream from the reservoir, allows for the egress of gases from the system. After utilized as the sweep gas, the inert gas leaves the cold trap, either to be expelled, or else purified, compressed, and reused/recycled.

Nuclear facility inert atmosphere hot cells normally use argon as the inert gas blanket. However, inasmuch as Argon (b.p. −186° C.) condenses very near that the point of nitrogen (b.p. −195° C.), co-condensation of the two gases entrained in the same downstream gas is likely to occur. To avoid argon contamination of condensed-out nitrogen-15, an inert carrier gas which stays in vapor phase even after liquid nitrogen treatment is required. Helium; with a boiling point −268° C. is suitable.

The shroud 43 over each electrorefiner provides a means for sealing off any fluid communication between the argon gas blanket utilized in typical nuclear facility operations and the invented reclaiming invention. Specifically, the shroud allows for the use of helium as a sweep gas, and prevents the problem of argon co-condensation in the liquid nitrogen trap while still allowing for the concomitant use elsewhere of argon as the bulk of the inert-atmosphere hot-cell gas blanket.

The hot cell atmosphere cooling system can serve as a cooling system for the electrorefiners and transport and reject waste heat.

The invention exploits the phenomenon that the more negative the potential of a reaction, the less spontaneous the reaction. In the case of separating ZrN from PuN, the first voltage of the first cell is therefore adjusted to be low enough in absolute value to decompose PuN but not ZrN. Specifically, the first voltage or decomposition voltage of PuN (−0.72 V) of the first cell 11 is less negative (a lower absolute value) than the second voltage or decomposition voltage of ZrN (−0.94 V) of the second cell 26. The negative values associated with the above example should be construed as applied voltage.

The process is continual with electrical communication between the anode basket 16 and the first cathode 20, and electrical communication between the anode basket 16 and the second cathode 30. Nitrogen-15 is continually being collected.

Noble metal fission products, such as molybdenum (Mo), ruthenium (Ru), palladium (Pd), niobium (Nb), and technetium (Tc), comprise a metallic residue remaining in the anode basket. To isolate these metals, the residue and basket screen are melted and alloyed with iron and zirconium to make a Integral Fast Reactor (IFR)-type metal waste form.

The plutonium and zirconium metals recovered from the cathodes are subsequently combined in a cathode processor where a plutonium-zirconium alloy is fabricated. This alloy is then reacted with nitrogen to produce a working nitride fuel.

For illustration purposes only, the electrochemical decomposition and refinement of a mixture of plutonium and zirconium nitrides is discussed infra.

Device Detail

The spent fuel is a mixture of transuranic and zirconium nitrides [(TRU-Zr)N. Transuranic nitrides (TRUN) are comprised of a transuranic element which comes from the group consisting of neptunium, plutonium, americium, and curium. The removable anode basket is a porous basket made of perforated sheet metal and lined with a fine metal screen. The material comprising the anode basket can be selected of a number of materials that include, but are not limited to, the group consisting of iron, steel, ferritic stainless steel, stainless steel, molybdenum, and molybdenum-tungsten alloy. The metal screen lining can be less than or equal to 300 mesh, and of the same material as the anode basket.

The first molten electrolyte is comprised of an alkali metal chloride such as lithium chloride (LiCl), and a material selected from the group consisting of neptunium chloride ($NpCl_3$), plutonium chloride ($PuCl_3$), americium chloride ($AmCl_3$), and curium chloride ($CmCl_3$). While there is a simple eutectic at 460° C. for LiCl—$PuCl_3$ (~30 mole (mol) % $PuCl_3$), the transuranic chloride (TRUCl) is initially present as 2.0 to 3.0 mol % of the LiCl-TRUCl molten matrix. For a LiCl—$PuCl_3$ solution which is 2.0 to 3.0 mol % $PuCl_3$, the freezing point is near 600° C. This is comfortably below the nominal operating temperature of 700° C.

The first cathode can be comprised of a number of metals that include, but are not limited to the group consisting of molybdenum, and molybdenum-tungsten alloy.

The second molten electrolyte is comprised of lithium chloride (LiCl), and zirconium chloride ($ZrCl_3$). Zirconium chloride, $ZrCl_3$, is present as 5.0 to 10.0 mol % of the molten matrix. An alternative molten matrix for the second cell 26 is LiF—$ZrF_3$ (~50 mol % $ZrF_3$).

The second cathode can be comprised of a number of different metals that include, but are not limited to the group consisting of iron, iron-chrome, and stainless steel. Both cell voltages can vary by ±20 milliVolts (mV). The nominal operating temperature for both cells of the electrorefiner is 700° C. The process is carried out at a temperature from between 690 and 710° C.

The theoretical decomposition voltage of plutonium nitride (PuN) is about −0.72 Volt (V) at 700° C. This voltage is comprised of two electrode potentials, the anode potential ($N^{3-}\rightarrow N^0$) is about +1.1 V and the cathode potential ($Pu^{3+}\rightarrow Pu^0$) is −1.831 V. The anode potential resulting from the oxidation of iron ($Fe^0\rightarrow Fe^{2+}$) is +0.52 V at 700° C. Since the spontaneous anode potential is less for iron than for the $N^{3-}N^0$ oxidation, ferrous metals in the anode basket and the metal screen lining will not be corroded.

The actual physical dimensions of the electrorefiner, the individual cells and electrodes are governed partially by criticality concerns, avoiding a critical mass of Pu.

The invented process and device can be applied to any spent nuclear fuel, especially those with two major metal components. The invention isolates the components of spent nitride fuels, reduces the quantity of waste produced which has to be buried at sites for nuclear reactor wastes, and maximizes the yields of valuable metals such as zirconium and plutonium.

The invented device and process effects separation of the spent nitride fuel into refined and purified transuranic metal, refined and purified zirconium metal; alkali metal chlorides, alkaline earth chlorides, and rare earth fission product chlorides; and noble metal fission products.

This invention also relates to an improved or enhanced electrochemical system which provides for multiple means of metal reduction. The process utilizes electrochemical separation based on the differences in metals' electrochemical properties, and a novel design for the separator/electrorefiner.

While the invention has been described with reference to details of the illustrated embodiment, these details are not intended to limit the scope of the invention as defined in the appended claims.

What is claimed is:

1. A process for separating the constituents of spent nuclear fuel containing a first nitride compound and a second nitride compound, the process comprising:

a) loading the spent fuel in an anode basket;

b) suspending the basket in a first molten electrolyte;

c) placing a first cathode in the first molten electrolyte;

d) applying a first voltage between the anode basket and the first cathode, whereby the first voltage decomposes the first nitride compound;

e) removing the anode basket;

f) placing the anode basket in a second molten electrolyte;

g) placing a second cathode in the second molten electrolyte; and h) applying a second voltage between the anode basket and the second cathode, whereby the second voltage decomposes the second nitride compound.

2. The process as recited in claim 1 wherein the first applied voltage is at a value below the decomposition voltage of the second nitride compound.

3. The process as recited in claim 1 wherein the second nitride compound is decomposed by the second applied voltage.

4. The process as recited in claim 1 wherein the first applied voltage is less than the second applied voltage.

5. The process as recited in claim 1 wherein the first molten electrolyte is comprised of an alkali metal chloride, and a material selected from the group consisting of neptunium chloride, plutonium chloride, americium chloride, curium chloride, or combinations thereof.

6. The process as recited in claim 1 wherein the second molten electrolyte is comprised of a salt selected from the group consisting of lithium salt and a zirconium salt.

7. The process as recited in claim 6 wherein the lithium salt comes from the group consisting of lithium chloride (LiCl) and lithium fluoride (LiF).

8. The process as recited in claim 6 wherein the zirconium salt comes from the group consisting of zirconium chloride ($ZrCl_3$) and zirconium fluoride ($ZrF_3$).

9. The process as recited in claim 1 wherein plutonium metal is produced at the first cathode.

10. The process as recited in claim 1 wherein zirconium metal is produced at the second cathode.

11. The process as recited in claim 1 wherein nitrogen-15 gas ($^{15}N_2$) is produced at the anode in both molten electrolytes.

12. The process as recited in claim 1 wherein there is electrical communication between the anode basket and the first cathode.

13. The press as recited in claim 1 wherein there is electrical communication between the anode basket and the second cathode.

* * * * *